United States Patent [19]

Caskey

[11] Patent Number: 4,648,445

[45] Date of Patent: Mar. 10, 1987

[54] RETRIEVING MECHANISM

[75] Inventor: Kenneth D. Caskey, Duncan, Okla.

[73] Assignee: Halliburton Company, Duncan, Okla.

[21] Appl. No.: 808,586

[22] Filed: Dec. 13, 1985

[51] Int. Cl.[4] ..... E21B 31/18

[52] U.S. Cl. ..... 166/98; 166/123; 166/181

[58] Field of Search ..... 166/98, 123, 125, 181, 166/182; 285/18, 330

[56] References Cited

U.S. PATENT DOCUMENTS

| | | | |
|---|---|---|---|
| 2,647,584 | 8/1953 | Baker et al. | 166/217 |
| 3,208,355 | 9/1965 | Baker et al. | 166/120 |
| 3,253,655 | 5/1966 | Brown | 166/120 |
| 3,306,363 | 2/1967 | McZilkey, Jr. | 166/152 |
| 3,306,366 | 2/1967 | Muse | 166/224 |
| 3,356,140 | 12/1967 | Young | 166/128 |
| 3,393,002 | 7/1968 | Woolley | 166/98 |
| 3,570,595 | 3/1971 | Berryman | 166/128 |
| 4,153,109 | 5/1979 | Szescila | 166/123 |
| 4,253,521 | 3/1981 | Savage | 166/123 |
| 4,290,484 | 9/1981 | Beall et al. | 166/242 |
| 4,363,358 | 12/1982 | Ellis | 166/181 |
| 4,372,388 | 2/1983 | Skinner | 166/334 |
| 4,372,391 | 2/1983 | Barrington et al. | 166/373 |
| 4,372,392 | 2/1983 | Barrington et al. | 166/373 |
| 4,477,104 | 10/1984 | Akkerman | 285/18 |
| 4,479,548 | 10/1984 | Gilbert | 166/123 |

OTHER PUBLICATIONS

Halliburton Services Catalog No. 40, p. 3477.

*Primary Examiner*—Stephen J. Novosad
*Assistant Examiner*—William P. Neuder
*Attorney, Agent, or Firm*—Joseph A. Walkowski

[57] ABSTRACT

A retrieving mechanism for subsurface releasing and retrieving of a downhole tool. The apparatus includes an overshot defining a central opening therethrough and an annular cavity therein and a mandrel positionable in the overshot central opening. A slotted C-ring with an internally threaded surface is annularly positioned in the cavity in the overshot. The mandrel includes an externally threaded portion. Longitudinal insertion of the mandrel in the overshot results in ratcheting expansion and contraction of the ring for threaded engagement with the mandrel. The threaded surfaces define a thread profile having a first surface, angled with respect to a central axis of the apparatus, which facilitates the longitudinal insertion of the mandrel in the ring, and a second surface, extending normally to the apparatus central axis, which prevents longitudinal disengagement. A seal is located above the ring for sealing engagement with a mandrel sealing surface. In a lower portion of the overshot, a rotation plug extends radially inwardly, and on a lower portion of the mandrel a corresponding lug extends radially outwardly. The lugs may be positioned adjacent one another for selectively preventing rotation of the overshot relative to the mandrel.

19 Claims, 10 Drawing Figures

RETRIEVING MECHANISM

BACKGROUND OF THE INVENTION

1. Field of the Invention

This invention relates to apparatus used in retrieving downhole tools, and more particularly, to a retrieving apparatus requiring only longitudinal motion for engagement to the downhole tool and rotational motion for release of the tool.

2. Description of the Prior Art

Most retrieving devices for downhole tools known in the art require rotational engagement. Typically, a threaded mandrel is threadingly engaged in a sleeve by rotation in one direction. Disengagement requires reverse rotation. Such a reverse rotation is undesirable in that another joint in the tool string may break before the desired disengagement of the overshot and mandrel of the retrieving device. The present invention solves this problem by providing engagement by longitudinal insertion of a threaded mandrel into a threaded, ratcheting C-ring. Longitudinal removal of the mandrel is prevented. A left-hand thread is used, so disengagement is accomplished by normal right-hand rotation. In this way, undesired disengagement of other tool string joints is prevented.

Collet type engaging apparatus are also known, but these are not adapted for supporting the weight of the tool string below the engaging apparatus. Because the ratcheting C-ring of the present invention only allows longitudinal movement of the mandrel in one direction, the full weight of the tool string below the retrieving mechanism may be supported thereby.

SUMMARY OF THE INVENTION

The retrieving mechanism of the present invention is an apparatus for retrieving and releasing a downhole tool from a tool string at a point in a well bore. The retrieving mechanism comprises overshot means, mandrel means defining a threaded portion thereon and having a portion engageable with the overshot means, and releasable connecting means for threadingly connecting the overshot means to the mandrel means upon relative longitudinal insertion of the mandrel means into the overshot means, and for disconnecting the overshot means from the mandrel means upon rotation of the overshot means relative to the mandrel means. The apparatus may further comprise rotational engagement means for selectively preventing rotation of the overshot means relative to the mandrel means, and seal means for sealing between the overshot means and the mandrel means.

The overshot means is attached to either the tool or tool string, and the mandrel means is attached to the other of the tool or the tool string. In the preferred embodiment, the overshot means is attached to the lower end of the tool string, and the mandrel means is attached to the upper end of the tool to be retrieved.

The overshot means and mandrel means define a substantially annular recess or cavity therebetween, and the releasable connecting means comprises ring means longitudinally slidably disposed in the cavity. The ring means defines a threaded surface thereon and has a radially expanded position for longitudinally receiving the mandrel means threaded portion and a contracted, normal position in which the ring means threaded surface is in threaded engagement with the mandrel means threaded portion.

The ring means is best characterized by a substantially annular ring having slot means, preferably in the form of a longitudinal slot, therein. Thus, the ring means comprises a ring of substantially C-shaped cross section, or a C-ring. The releasable connecting means further comprises key means on the overshot means which extends into the slot means for engagement therewith. As the overshot means is rotated in one direction with respect to the mandrel means, the ring means is concurrently rotated, whereby the ring means is threadingly disengaged from the mandrel means threaded portion. In the preferred embodiment, the threaded portion of the mandrel means and the threaded surface on the ring means define a left-hand thread, so that right-hand rotation is used for disengagement. This eliminates reverse rotation which may break an undesired tool string joint.

The annular cavity comprises a first, large upper portion which provides clearance for the expansion of the ring means from the normal position to the expanded position during longitudinal insertion of the mandrel means, and a second, small lower portion for closely receiving the ring means so that expansion of the ring means is prevented.

As the mandrel means is longitudinally moved into the ring means, the ring means expands and contracts in a ratcheting manner. The threaded portion of the mandrel means and the threaded surface of the ring means each define a thread comprising a first surface extending at an acute angle to a central axis of the apparatus and a second surface, opposite the first surface, which extends substantially normally to the apparatus central axis. The angle first surfaces facilitate the longitudinal, ratcheting insertion of the mandrel means into the ring means, and the normal second surfaces prevent longitudinal disengagement of the mandrel means and ring means. Thus, disengagement may be accomplished only by the right-hand rotation abovedescribed.

In the preferred embodiment, the rotation means comprises a lug on the overshot means and a corresponding lug on the mandrel means. The lugs are engageable when the overshot means and mandrel means are in a predetermined longitudinally relative position. When the lugs are so engaged, rotation of the overshot will rotate the mandrel so that threading disengagement of the mandrel means and ring means is prevented. Each of the lugs has a transverse end defining at least one surface at an acute angle to the central axis of the apparatus. Thus, if the lugs are in a position in which they may obstruct one another during longitudinal movement between the overshot means and mandrel means, the angle surfaces will rotationally deflect the lugs away from one another.

In the preferred embodiment, the overshot means is characterized as an overshot defining a central opening therethrough and comprising an upper portion defining a seal cavity, an intermediate portion defining the annular ring receiving cavity therein, and a lower portion having the rotation lug extending radially inwardly therefrom. The mandrel means is characterized by a mandrel defining a central opening therethrough and comprising an upper portion defining a sealing surface thereon, an intermediate having an external surface defining the threaded portion, and a lower portion including the rotation lug extending radially outwardly therefrom.

The seal means is characterized by a sealing member positioned in the seal cavity of the overshot for sealing engagement with the upper portion of the mandrel.

As the overshot is lowered onto the mandrel for longitudinal insertion of the mandrel in the overshot central opening, the mandrel sealing surface sealingly engages the seal and the mandrel threaded surface engages the threaded surface of the annular ring such that the ring is moved to the cavity upper portion in which the ring is radially expanded for the ratcheting engagement hereinbefore described. After engagement, as the overshot is raised, the ring is moved to the lower portion of the cavity such that expansion of the ring is prevented.

An important object of the invention is to provide a retrieving apparatus for subsurface release and retrieval of a downhole tool.

Another object of the invention is to provide a retrieving mechanism providing threading engagement of a mandrel and overshot by longitudinal insertion of the mandrel into the overshot, while requiring relative rotation between the mandrel and overshot for disengagement.

An additional object of the invention is to provide an apparatus for retrieving and releasing a downhole tool by utilizing only right-hand rotation.

A further object of the invention is to provide a tool retrieving mechanism for selectively preventing relative rotation between a tool string and downhole tool and providing rotational release of the tool by rotation in the same direction.

Additional objects and advantages of the invention will become apparent as the following detailed description of the preferred embodiment is read in conjunction with the accompanying drawings which illustrate such preferred embodiment.

DESCRIPTION OF THE PREFERRED EMBODIMENT

Figure 1A:
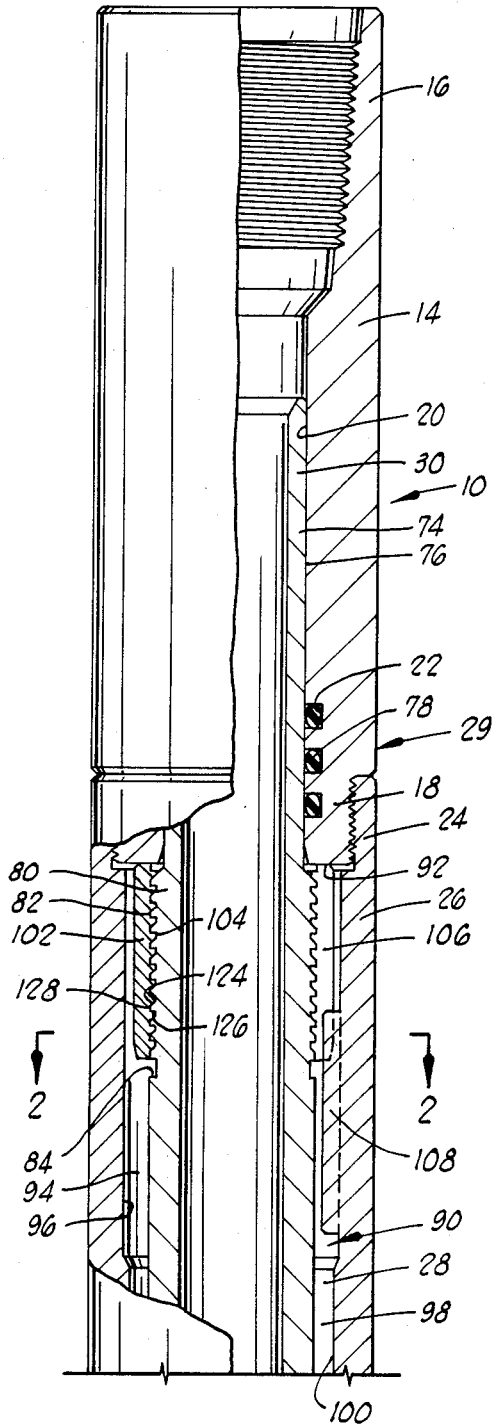
FIGS. 1A-1D show a partial longitudinal cross section of the apparatus of the present invention.

Referring now to the drawings, and more particularly to FIGS. 1A-1D, the apparatus of the present invention is shown with a retrieving mechanism, generally designated by the numeral 10, and a subsurface control valve, generally designated by the numeral 12. FIGS. 1A-1D show the retrieving mechanism 10 in a position just after engagement with control valve 12. Valve 12 is in a closed position.

Retrieving mechanism 10 includes a body 14 having an upper threaded end 16 for engagement with a tool string and a lower end 18. Body 14 defines a central opening 20 therethrough with a plurality of seal cavities 22 adjacent lower end 18.

Lower end 18 of body 14 is preferably threadingly engaged with upper end 24 of a sleeve 26 which defines a central opening 28 therethrough in communication with central opening 20 of body 14. Body 14 and sleeve 26 thus form overshot means characterized by an overshot 29 used in a manner hereinafter described.

Retrieving mechanism 10 further includes mandrel means in the form of an elongated mandrel 30 extending upwardly from valve body 32 of control valve 12, and threadingly engaged therewith. Mandrel 30 defines a central opening 34 therethrough which corresponds to, and is aligned with, opening 36 defined in valve body 32.

Control valve 12 includes sleeve means reciprocably disposed in an annular body means. The body means is best characterized by a valve body 32 which preferably includes an upper collar 38 attached to an upper end of a ring 40. An intermediate sleeve 42 is attached to the lower end of ring 40, and the intermediate sleeve is attached at its lower end to a housing 44. Housing 44 is threadingly engaged with a lower collar 46. Valve body 32 further defines a general central opening 48 therethrough of varying diameters.

The sleeve means of control valve 12 includes a valve sleeve assembly 50 reciprocably disposed in central opening 48 of body 32. Valve sleeve assembly 50 preferably includes shouldering mandrel 52 threadingly engaged with an upper valve sleeve 53 having an upper valve seat 54 mounted thereon, a lower valve sleeve 56 with a lower valve seat 58 mounted at an upper end of the lower sleeve. Lower valve sleeve 56 is threadingly engaged with a shouldering sleeve 60, and the shouldering sleeve is threadingly engaged with a lower adapter 62. Adapter 62 has a lower end 64 adapted for threading engagement with a downhole tool or tool string.

Rotatably positioned between upper valve seat 54 and lower valve seat 58 is a ball valve element 66 having a recess 68 therein and providing valve means for alternately opening and closing control valve 12. Annularly positioned between ring 40 and housing 44 of body 32, and radially within intermediate sleeve 42, are a pair of actuators 70, each having an actuator arm 72 thereon which extends into, and engages, recess 68 in ball valve element 66. Upper valve sleeve 53 and lower valve sleeve 56 are held in place about ball valve element 66 by a pair of longitudinally oriented C-clamps which extend from above to below ball valve element 66 and lock into slots (not shown) in the valve sleeves. The arrangement is known in the art and is disclosed in U.S. Pat. No. 3,814,182 to Giroux assigned to Halliburton Company and hereby incorporated herein by reference.

Referring now to FIG. 1A, mandrel 30 includes an upper portion 74 having an outside diameter defining a sealing surface 76 thereon. Upper portion 74 extends into central opening 20 of body 14 when in the position shown in FIG. 1A. Each seal cavity 22 holds a seal 78 therein, such as an O-ring, for sealing engagement between sealing surface 76 of mandrel 30 and body 14 of overshot 29.

An intermediate portion 80 of mandrel 30 defines an externally threaded surface 82 thereon and an outwardly directed annular shoulder 84 positioned below the threaded surface.

Sleeve 26 of overshot 29 includes an inwardly directed, upwardly facing annular shoulder 86 and an inner surface 87 in close spaced relationship to outer surface 88 of mandrel 30. It will be seen that a substantially annular recess or cavity 90 is defined between sleeve 26, shoulder 86, mandrel 30 and a downwardly facing annular shoulder formed by lower surface 92 of body 14. Cavity 90 includes a first, upper portion 94 having a substantially constant inside diameter 96 and a second, lower portion 98 with a substantially constant inside diameter 100. In the preferred embodiment, inside diameter 100 is less than inside diameter 96.

Figure 2:
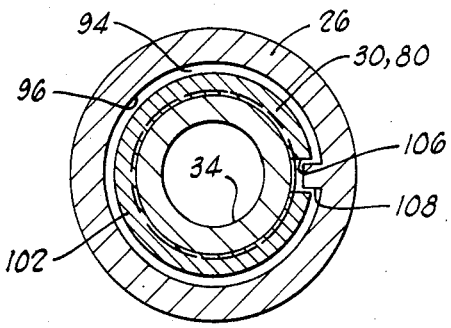
FIG. 2 is a transverse cross section taken along lines 2—2 in FIG. 1A.

Referring now to FIGS. 1A and 2, a ring 102 of substantially C-shaped cross section is longitudinally slidably disposed in cavity 90. Ring 102, which may be referred to as a C-ring, has a threaded internal surface 104 engageable with threaded surface 82 of intermediate portion 80 of mandrel 30. The C-shaped cross section of ring 102 thus defines a longitudinal slot 106 therealong.

Extending radially inwardly on sleeve 26, and preferably positioned in upper portion 94 of cavity 90 is a substantially longitudinal key 108 adapted for engagement with slot 106 in ring 102. Preferably, key 108 is of sufficient length such that it always engages slot 106 regardless of the longitudinal position of ring 102 within cavity 90.

Figure 1B:
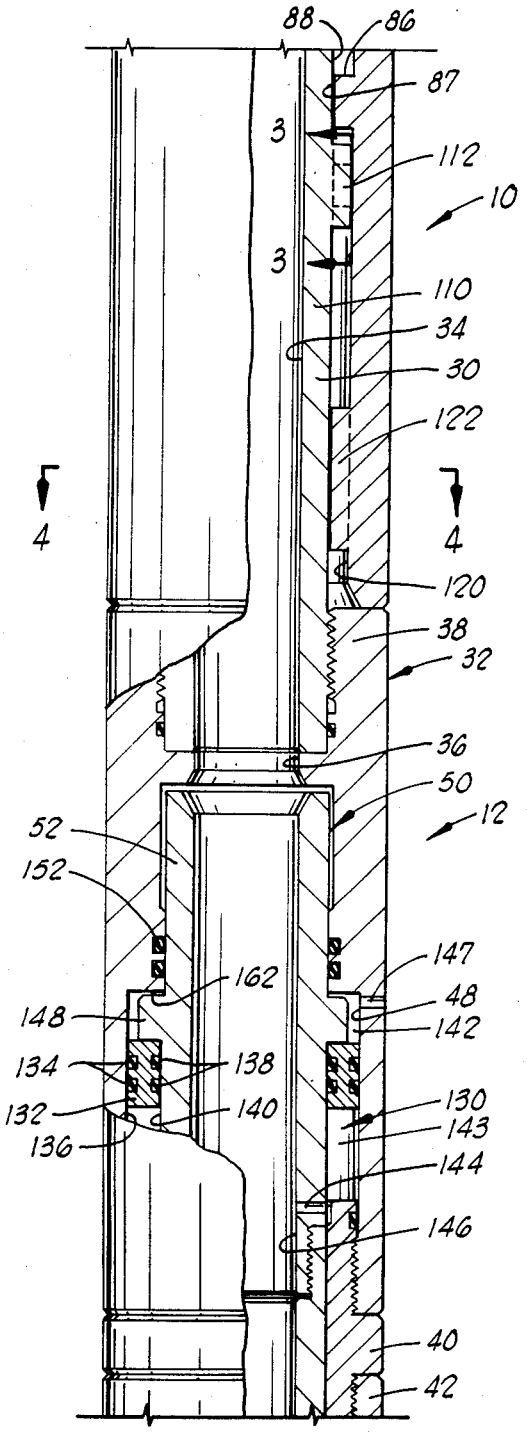
Figure 3:
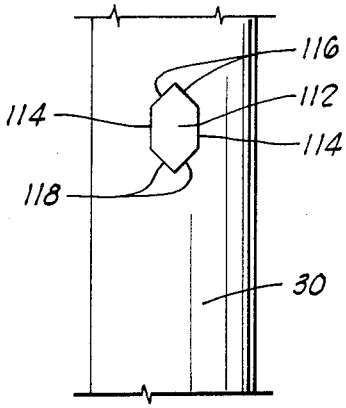
FIG. 3 illustrates a partial elevation of a mandrel as viewed along lines 3—3 in FIG. 1B.
Figure 4:
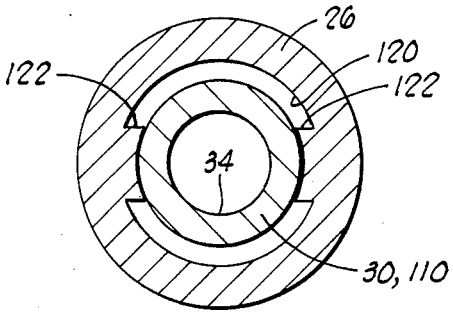
FIG. 4 shows a transverse cross section taken along lines 4—4 in FIG. 1B.

Referring now to FIGS. 1B, 3 and 4, mandrel 30 further includes a lower portion 110 having at least one substantially longitudinal lug 112 extending radially outwardly therefrom. Each lug 112 has a pair of longitudinal sides 114, an upper transverse end defined by a pair of sides 116 extending at an acute angle to sides 114, and thus to a central axis of the apparatus, and a lower transverse end defined by similarly angled sides 118.

Extending radially inwardly from inner surface 120 of sleeve 26 is at least one substantially longitudinal lug 122. Lug 122 has longitudinal sides and upper and lower transverse ends defined by angled sides in a manner similar to lug 112 on mandrel 30.

Threaded surface 82 on intermediate portion 80 of mandrel 30 and threaded surface 104 in ring 102 each defines a thread with a profile having a first surface 124 which extends at an acute angle with respect to the central axis of the apparatus and a second surface 126 opposite the first surface which extends substantially normal to the central axis. The thread profile also preferably includes a cylindrical outer surface 128.

During assembly, mandrel 30 is longitudinally inserted in overshot 29. Thus, seal surface 76 is inserted into central opening 20 of body 14 and sealingly engaged by seals 78. Ring 102 is made of a sufficiently resilient material, such as hardened steel, so that it will expand radially outwardly and contract radially inwardly in a ratcheting manner as mandrel 30 is forced into the ring. Angled surfaces 124 on the threads facilitate the longitudinal insertion of mandrel 30 into ring 102. As threaded surfaces 82 and 104 are aligned, ring 102 will contract to a normal position in which the threaded surfaces are in threaded engagement.

Normal surfaces 126 of the threads prevent axial disengagement of mandrel 30 and ring 102. Disengagement may only be accomplished by rotating overshot 29 with respect to mandrel 30 for threading disengagement. Thus, releasable connecting means are provided for threadingly connecting the overshot means to the mandrel means upon longitudinal insertion of the mandrel means into the overshot means, and for disconnecting the overshot means from the mandrel means upon rotation of the overshot means relative to the mandrel means.

Preferably, threaded surfaces 82 and 104 comprise lefthand threads so that right-hand rotation of overshot 29 is all that is required. In this way, reverse rotation of the tool string is eliminated.

Referring again to FIG. 1B, it will be seen that upper collar 38 and ring 40 of body 32 of control valve 12, along with upper sleeve 52 of valve sleeve assembly 50 define a substantially annular piston cavity 130 therebetween.

Reciprocably positioned in piston cavity 130 is a substantially annular piston 132 with outer piston rings or seals 134 for sealing engagement with outside diameter 136 of the piston cavity. Inner piston rings 138 provide sealing engagement with inside diameter 140 of piston cavity 130. Outer piston rings 134 and inner piston rings 138 are preferably O-rings. It will be seen that piston 132 divides piston cavity 130 into an upper portion 142 and a lower portion 143.

A transverse opening 144 in upper sleeve 52 adjacent a lower end of piston cavity 130 provides fluid communication between central opening 146 of sleeve assembly 50 and lower portion 143 of the piston cavity. At the upper end of piston cavity 130, a transverse opening 147 in upper collar 38 provides fluid communication between upper portion 142 of the piston cavity and a well annulus between the apparatus and a well casing in which the apparatus is located.

A shoulder portion 148 extends radially outwardly from an intermediate portion of shouldering mandrel 52 in upper portion 142 of piston cavity 130 at a point above piston 132. It will be seen that seals 150 in ring 40, shown in FIG. 1C, and seals 152 in upper collar 38, shown in FIG. 1B, sealingly enclose annular piston cavity 130 regardless of the relative position between sleeve assembly 50 and body 32 of control valve 12.

Figure 1C:
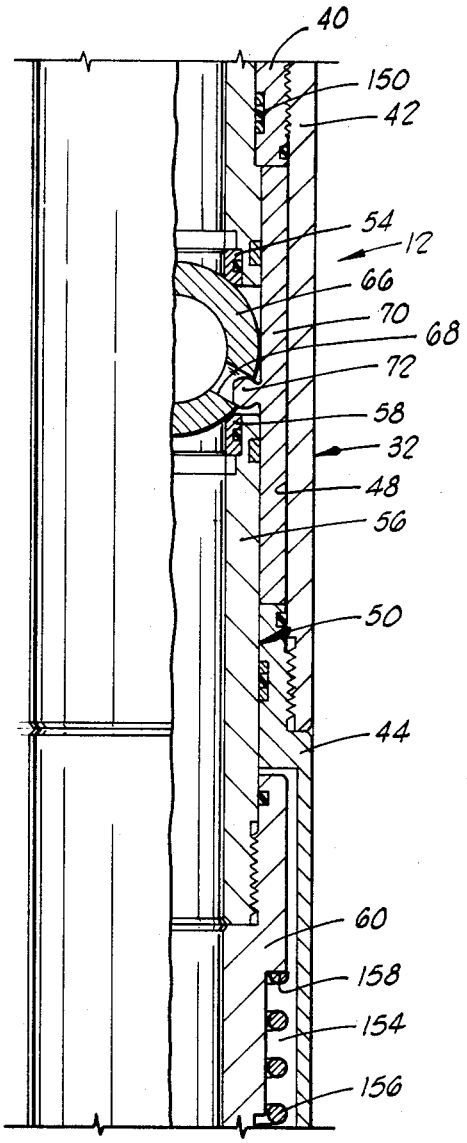
Figure 1D:
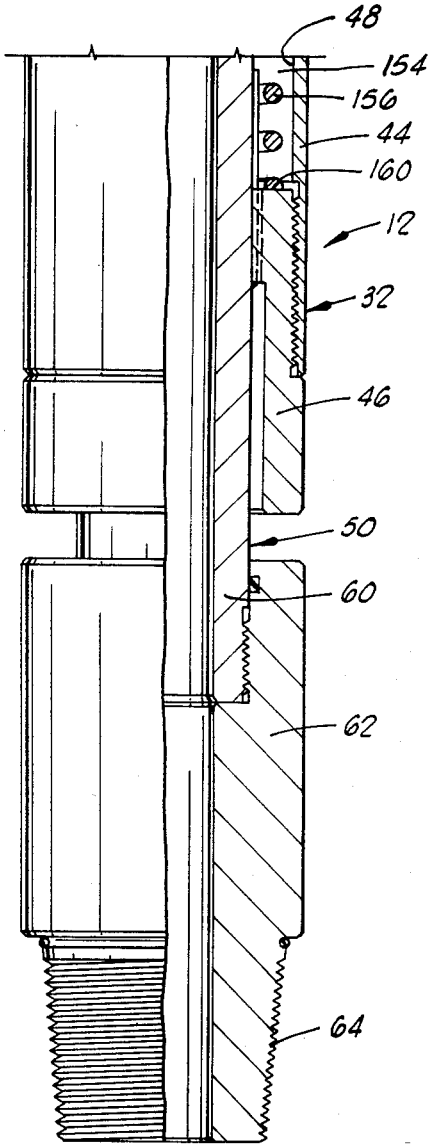

Referring now to FIGS. 1C and 1D, housing 44, lower collar 46 and shouldering sleeve 60 define a substantially annular spring receiving cavity 154 therein. A compression spring 156 is positioned in cavity 154 and bears against shoulder 158 of shouldering sleeve 60 and upper shoulder surface 160 of lower collar 46. Preferably, spring 156 is always in compression so that shoulder 158 and upper shoulder surface 160 are oppositely biased. It will be seen that this spring force thus provides a means for biasing valve sleeve assembly 50 to a relatively converged position with respect to body 32 such that shoulder 148 of shouldering mandrel 52 is adjacent annular shoulder 162 in upper collar 38, as shown in FIG. 1B.

OPERATION OF THE APPARATUS

Referring now to FIGS. 1A–1D and 5–7, an operating sequence of retrieving mechanism 10 and subsurface control valve 12 will be described as used in conjunction with a packer 164.

Figure 5:
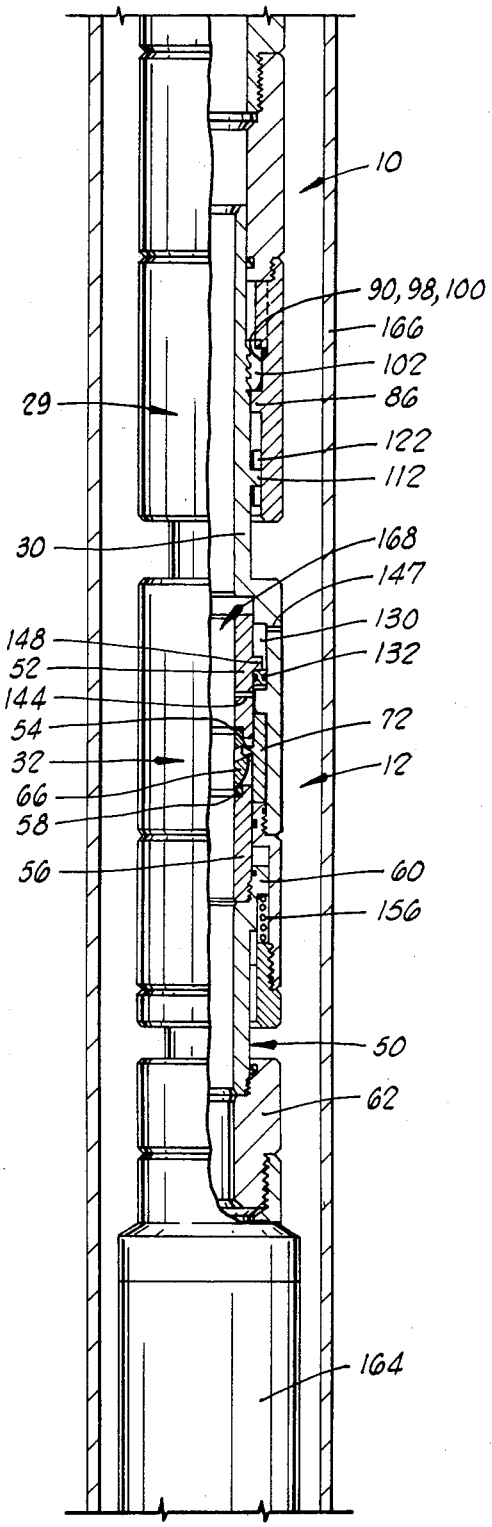
FIG. 5 is a schematic partial cross section of the retrieving mechanism, subsurface control valve and packer as the assembly is lowered into a well casing.

When the apparatus is lowered into a well casing 166, it is in the configuration shown in FIG. 5. Packer 164 is attached to adapter 62 at the lower end of valve sleeve assembly 50. Threaded portion 82 of mandrel 30 is engaged with threaded surface 104 of ring 102 in overshot 29. The weight of control valve 12, packer 164 and any tool string elements below the packer forces mandrel 30 to a downward position with respect to overshot 29 in which ring 102 is located in small, lower portion 98 of cavity 90 and bearing against shoulder 86. As already indicated, expansion of ring 102 is prevented in this position, and the shape of the threads prevent longitudinal disengagement of mandrel 30 with the ring.

A study of the extended position of FIG. 5 will show that lug 112 on mandrel 30 and lug 122 in overshot 29 are longitudinally aligned with one another. Thus, rotation of overshot 29 will rotate mandrel 30, and therefore control valve 12 and all elements of the tool string therebelow, without threading disengagement of the mandrel with ring 102.

The weight of packer 164 and of the tool string elements therebelow is sufficient to overcome the force exerted by spring 156 so that the spring is further compressed. Valve sleeve assembly 50 of control valve 12 is thus in a relatively extended position with respect to body 30. The result is that shouldering mandrel 52 and lower sleeve 56 which support ball valve element 66 are downwardly displaced with respect to actuator arm 72 which is stationary in body 30. Actuator arm 72 thus acts as a valve actuation means for causing ball valve element 66 to rotate within upper seat 54 and lower seat 58 to a fully open position shown in FIG. 5. As long as the weight overcomes the force of string 156, means are thus also provided for maintaining control valve 12 in an open position when lowered into the well bore. It will be seen by those skilled in the art that retrieving mechanism 10 and control valve 12 define a substantially unobstructed central flow passage 168 therethrough when the valve is in the open position.

In the relatively extended position of control valve 12 shown in FIG. 5, piston 132 is displaced to the lower end of cavity 130 by shoulder 148. Fluid from the well annulus flows through transverse opening 147 into cavity 130. Thus, transverse opening 147 prevents a possible vacuum in cavity 130.

Figure 6:
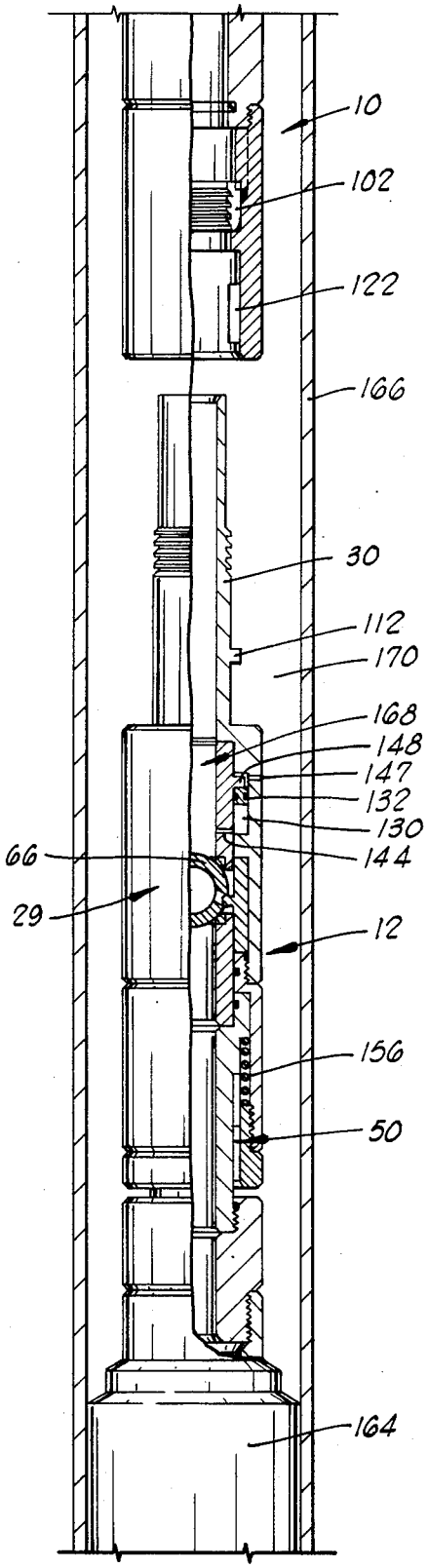
FIG. 6 schematically illustrates the packer in an expanded position with the retrieving mechanism disengaged from the subsurface control valve.
Figure 7:
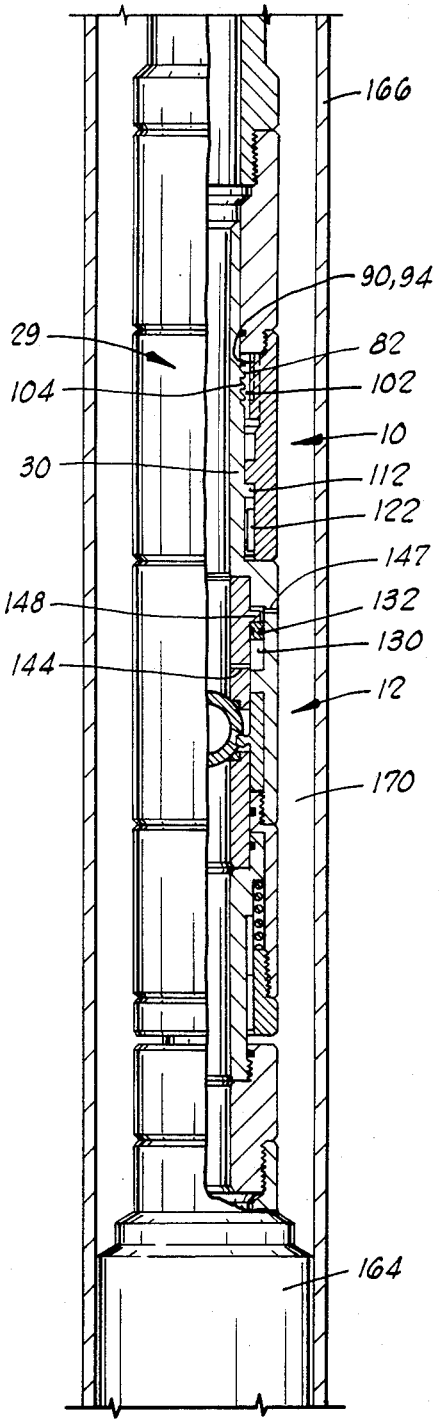
FIG. 7 is a schematic showing the retrieving mechanism as it is re-engaged with the subsurface control valve.

When it is desirable to close off well casing 166, packer 164 is actuated in a manner known in the art to the position shown in FIG. 6 in which it is sealingly engaged with an inner surface of the well casing. Packer 164 is preferably retrievable. When packer 164 is engaged, it will support the weight of any tool string elements below it.

After engagement of packer 164, overshot 29 may be moved downwardly with respect to mandrel 30 and control valve 12 such that lugs 112 and 122 are no longer engaged, as best shown in FIG. 1B. This downward displacement of overshot 29 relieves tension on mandrel 30. Further downward displacement of overshot 29 moves body 32, and thus mandrel 30, downwardly with respect to valve sleeve assembly 50 which is stationary in the well along the packer 164. It will be seen by those skilled in the art that in this relatively converged position of control valve 12, ball valve element 66 is rotated back to a closed position, obstructing central flow passage 168. Thus, means are provided for closing valve 12.

After the initial relief of tension on mandrel 30, the force exerted by spring 156 and the weight of the valve body will generally be sufficient to automatically close control valve 13.

In the relatively converged, closed position of control valve 12, shoulder 148 on valve sleeve assembly 50 is moved relatively upwardly so that it is again adjacent shoulder 162 in body 32. When body 32 and valve sleeve assembly 50 are thus relatively converged, the total volume of central flow passage 168 above valve element 66 is reduced.

Balancing piston 132 provides an upward force on shoulder 148 whenever central flow passage 168 is pressured up to test the integrity of the seal of ball valve element 66 on lower seat 58. This upward force balances the forces created by the pressure increase in central flow passage 168 to assure that valve body 32 of control valve 12 is not "pumped upward" by the pressure differential which would open the ball valve element 66.

When overshot 29 is moved toward control valve 12, lug 112 on mandrel 30 and lug 122 in overshot 29 are no longer engaged which permits relative rotation of the overshot and mandrel. Rotation of the overshot thus threadingly disengages ring 102 from mandrel 30. As previously indicated, use of the preferred left-hand threads for mandrel threaded portion 82 and ring threaded surface 104 allows right-hand rotational disengagement. Reverse rotation and the possibility of undesired disengagement of other joints in the tool string are avoided. After disengagement, overshot 29 may be removed from well annulus 166, as shown in FIG. 6.

Spring 156 provides a biasing means for maintaining control valve 12 in the closed position when overshot 29 is disengaged from mandrel 30.

To retrieve control valve 12 along with packer 164 and the tool string elements below the packer, it is only necessary to lower overshot 29 back into well annulus 166 and stab the overshot over mandrel 30. During the stab-over operation, best illustrated in FIG. 7, threaded surface 82 of mandrel 32 will force ring 102 into upper portion 94 of cavity 90, again allowing ratcheting expansion of ring 102 so that the mandrel threaded surface engages threaded surface 104 of the ring as hereinbefore described.

After re-engagement, overshot 10 is raised with respect to control valve 12 to force the control valve into the open position thereof and to engage lugs 112 and 122. As this occurs, shoulder 148 again forces piston 132 relatively downwardly in piston cavity 130 so that fluid in lower portion 143 of the piston cavity is forced through opening 144 into central flow passage 168, again compensating for the change in volume in the flow passage and maintaining a substantially constant pressure in control valve 12.

Packer 164 may then be disengaged, and the entire tool string lifted out of well casing 166, again as shown in FIG. 5.

It can be seen, therefore, that the retrieving mechanism and subsurface control valve of the present invention are well adapted to carry out the ends and advantages mentioned as well as those inherent therein. While a presently preferred embodiment of the apparatus has been shown for the purposes of this disclosure, numerous changes in the construction and arrangement of the parts may be made by those skilled in the art. All such changes are encompassed within the scope and spirit of this invention as defined by the appended claims.

What is claimed is:

1. A tool retrieving apparatus for retrieving and releasing a downhole tool, said apparatus comprising:

overshot means attached to one of said tool and a tool string;

mandrel means attached to the other of said tool and said tool string and defining a threaded portion thereon, said mandrel means having a portion engageable with said overshot means;

releasable connecting means for threadingly connecting said overshot means to said mandrel means upon longitudinal insertion of said mandrel means into said overshot means, and for disconnecting said overshot means from said mandrel means upon rotation of said overshot means relative to said mandrel means, and rotational engagement means operably associated with said overshot means and said mandrel means, for selectively preventing rotation of said overshot means relative to said mandrel means.

2. The apparatus of claim 1 wherein said rotational engagement means comprises a lug on said overshot means and a corresponding lug on said mandrel means, said lugs being engageable when said overshot means and said mandrel means are in a predetermined longitudinally relative position.

3. The apparatus of claim 1 further comprising seal means for sealing between said overshot means and said mandrel means.

4. The apparatus of claim 1 wherein:

said overshot means and said mandrel means define a substantially annular cavity therebetween; and said releasable connecting means comprises ring means disposed in said cavity, said ring means defining a threaded surface thereon and having a radially expanded position for longitudinally receiving said mandrel means threaded portion and a normal position in which said ring means threaded surface is in threaded engagement with said threaded portion.

5. The apparatus of claim 4 in which said cavity comprises:

a large portion providing clearance for expansion of said ring means from said normal position to said expanded position; and a small portion preventing said expansion of said ring means.

6. The apparatus of claim 4 wherein:

said ring means is characterized by a substantially annular ring having longitudinal slot means therein; and said releasable connecting means further comprises key means on said overshot means and extending into said slot means for engagement therewith, such that as said overshot means is rotated in one direction with respect to said mandrel means, said annular ring is concurrently rotated, whereby said annular ring is threadingly disengaged from said mandrel means threaded portion.

7. The apparatus of claim 1 wherein said threaded portion of said mandrel means comprises a left-hand thread.

8. A downhole retrieving apparatus comprising:

a mandrel having a threaded surface thereon;

an overshot defining a central opening therethrough and a surface forming an annular cavity extending radially outwardly from said central opening, said overshot further having a key extending radially inwardly from said surface forming said cavity; and a ratcheting ring longitudinally slidably disposed in said annular cavity and having slot means therein engageable with said key for preventing relative rotational movement between said ring and said overshot, said ring further having a threaded surface thereon conforming to said mandrel threaded surface;

whereby, as said mandrel is axially inserted into said overshot central opening, said ring and said mandrel are ratchetingly engaged such that said mandrel threaded surface is adjacent and engaged with said ring threaded surface, said threaded surfaces being adapted for rotational disengagement.

9. The apparatus of claim 8 wherein:

said overshot includes a radially inwardly extending lug; and said mandrel includes a radially outwardly extending lug, said lugs being positionable adjacent one another when said mandrel and ring threaded surfaces are at least partially engaged for preventing relative rotation between said overshot and said mandrel.

10. The apparatus of claim 9 wherein a transverse end of each of said lugs defines a surface at an acute angle with respect to a central axis of the apparatus.

11. The apparatus of claim 8 wherein said cavity comprises:

a first portion having a diameter providing clearance for ratcheting expansion of said ring; and a second portion having a diameter smaller than said first portion such that ratcheting expansion of said ring is prevented.

12. The apparatus of claim 8 further comprising shoulder means for limiting relative longitudinal movement between said ring and said mandrel as the mandrel is inserted into the overshot central opening.

13. The apparatus of claim 8 wherein:

each of said threaded surfaces of said mandrel and said ring comprises:

a first surface extending at an acute angle to a central axis of the apparatus; and a second surface opposite said first surface and extending substantially normally to said central axis;

whereby, said angled first surfaces facilitate axial engagement of said mandrel and ring, and said normal second surfaces prevent axial disengagement of said mandrel and ring.

14. The apparatus of claim 8 further comprising:

a seal surface on said mandrel; and seal means in said overshot central opening for providing sealing engagement between said overshot and said mandrel seal surface.

15. The apparatus of claim 14 wherein:

said seal means is above said annular cavity; and said mandrel seal surface is above said mandrel threaded surface.

16. A retrieving mechanism for retrieving and releasing a downhole tool at a predetermined position in a well bore, said retrieving mechanism comprising:

an overshot attached to a tool string and extending downwardly therefrom, said overshot defining a central opening therethrough and comprising:

an upper portion defining a seal cavity therein;

an intermediate portion defining an annular ring receiving recess therein, said recess having a first, large diameter portion and a second, small diameter portion, said intermediate portion further having a longitudinal key extending radially inwardly from an outer surface of said recess; and a lower portion having a rotation lug extending radially inwardly therefrom;

an annular ring of substantially C-shaped cross section disposed in said ring receiving recess and defining a longitudinal slot therealong engaged by said key for rotation of said ring with said overshot, said ring defining an internally threaded surface therein and further having an outside diameter dimensioned for close tolerance when in said recess second portion and for radial clearance when in said recess first portion;

a mandrel attached to said tool and extending upwardly therefrom, said mandrel comprising:

an upper portion defining a sealing surface thereon;

an intermediate portion defining an externally threaded surface thereon; and a lower portion having a rotation lug extending radially outwardly therefrom; and a seal disposed in said overshot seal cavity; wherein:

as said overshot is lowered onto said mandrel for longitudinal insertion of said mandrel in said overshot central opening:

said mandrel sealing surface sealingly engages said seal; and said mandrel threaded surface engages said ring threaded surface such that said ring is moved to said recess first portion, said ring being expandable therein for ratcheting axial engagement with said mandrel threaded surface, said threaded surfaces being adapted for only rotational disengagement; and as said overshot is raised, said ring is moved to said recess second portion such that expansion of said ring is prevented and said rotation lugs are positioned adjacent one another for mutual engagement thereof when said overshot is rotated.

17. The apparatus of claim 16 wherein said threaded portions define a left-hand thread.

18. The apparatus of claim 16 wherein said mandrel and ring threaded surfaces each define a thread having one surface extending normal to a central axis and another surface extending at an acute angle to said central axis.

19. The apparatus of claim 16 wherein at least a portion of said lugs are mutually engaged when at least a portion of said mandrel and ring threaded surfaces are engaged.

* * * * *